US006669793B2

(12) United States Patent
Hays

(10) Patent No.: US 6,669,793 B2
(45) Date of Patent: Dec. 30, 2003

(54) MICROSTRUCTURE CONTROLLED SHEAR BAND PATTERN FORMATION IN DUCTILE METAL/BULK METALLIC GLASS MATRIX COMPOSITES PREPARED BY SLR PROCESSING

(75) Inventor: Charles C. Hays, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 09/842,272

(22) Filed: Apr. 24, 2001

(65) Prior Publication Data

US 2002/0003013 A1 Jan. 10, 2002

Related U.S. Application Data

(60) Provisional application No. 60/199,219, filed on Apr. 24, 2000.

(51) Int. Cl.[7] ..... C22C 45/00
(52) U.S. Cl. ..... 148/561; 148/403
(58) Field of Search ..... 148/403, 561

(56) References Cited

U.S. PATENT DOCUMENTS

| | | | | |
|---|---|---|---|---|
| 4,377,622 A | * | 3/1983 | Liebermann | 148/561 |
| 5,567,251 A | | 10/1996 | Peker et al. | 148/561 |
| 5,708,553 A | | 1/1998 | Hung | |
| 5,735,975 A | | 4/1998 | Lin et al. | 148/403 |
| 5,781,394 A | | 7/1998 | Lorenz et al. | |
| 5,901,027 A | | 5/1999 | Ziegler et al. | |
| 6,010,580 A | | 1/2000 | Dandliker et al. | 148/403 |

FOREIGN PATENT DOCUMENTS

DE 3734214 A1 4/1989

OTHER PUBLICATIONS

Conner, R.D. et al., "Mechanical Properties of . . . Matrix Composites", *Acta Mater.*, vol. 46, No. 17, 1998, pp. 6089–6102.*

Eckert, J. et al. "Mechanically alloyed $Zr_{55}Al_{10}Cu_{30}Ni_5$ metallic glass composites containing nanocrystalline W particles." *Journal of Applied Physics* (1999): 7112–1779.

Xing, L.Q. et al. "High–strength materials produced by precipitation of icosahedral quasicrystals in bulk Zr–Ti–Cu–Ni–Al amorphous alloys." *Applied Physics Letters* (1999): 664–666.

Xing, L.Q. et al. "Deformation mechanism of amorphous and partially crystallized alloys." *NanoStructured Materials* (1999):503–506.

Eckert, J. "Mechanical alloying of bulk metallic glass forming systems." *Materials Science Forum* (1999):3–12.

Schurack, F. et al. "Synthesis and properties of mechanically alloyed and ball milled high strength amorphous or quasicrystalline Al–alloys." *Materials Science Forum* (1999):49–54.

Kubler, A. et al. "Nanoparticles in an amorphous $Zr_{55}Al_{10}Cu_{30}Ni_5$–matrix—the formation of composites by mechnical alloying." *Nanostructural Materials* (1999):443–446.

Eckert, J. et al. "Nanophase composites in easy glass forming systems." *NanoStructured Materials* (1999):439–442.

Schlorke, N. et al. "Properties of Mg–Y–Cu glasses with nanocrystalline particles." *NanoStructured Materials* (1999): 127–130.

Eckert, J. et al. "Mechanically alloyed Mg–based metallic glasses and metallic glass composites containing nanocrystalline particles." *Z Metallkd 90* (1999):908–913.

Shingu, P.H. "Metastability of amorphous phases and its application to the consolidation of rapidly quenched powders." *Materials Science and Engineering* (1988):137–141.

* cited by examiner

*Primary Examiner*—George Wyszomierski
(74) *Attorney, Agent, or Firm*—Fish & Richardson P.C.

(57) ABSTRACT

A new metallic glass is formed by adding special additives to a metallic glass matrix; the additives having ductile properties to form as dendrites in the metallic glass. The additives distribute the shear lines in the metallic glass, allowing it to plastically deform more than previous materials.

20 Claims, No Drawings

MICROSTRUCTURE CONTROLLED SHEAR BAND PATTERN FORMATION IN DUCTILE METAL/BULK METALLIC GLASS MATRIX COMPOSITES PREPARED BY SLR PROCESSING

CROSS-REFERENCE TO RELATED APPLICAITONS

This application claims benefit under 35 USC 119/120 from U.S. Provisional Application No. 60/199,219, filed Apr. 24, 2000.

BACKGROUND

A glass is a material that when cooled from its heated liquid transforms to the solid state without forming crystals. Such non-crystallized materials are also called amorphous materials. For example, one of the better known amorphous materials is quartz, which can be used to form conventional window glass. Most metals crystallize when they are cooled from the liquid state at reasonable rates, which causes their atoms to be arranged into a highly regular spatial pattern or lattice. A metallic glass is one in which the individual metal atoms have settled into an essentially random arrangement. Metallic glasses are not transparent like quartz glasses and are often less brittle than window glass.

A number of simple metal alloys may also be processed to form a glass-like structure. Binary metal alloys near deep eutectic features of the corresponding binary phase diagrams may be prepared into a glassy structure on cooling from the liquid state at rates greater than 1000 degrees per second. These binary metallic glasses may possess different properties than crystalline metals. These different properties may be useful in certain applications.

Bulk metallic glass forming alloys are a group of multicomponent metallic alloys that exhibit exceptionally high resistance to crystallization in the undercooled liquid state. Compared with the rapidly quenched binary metallic glasses studied prior to 1990, these alloys can be vitrified at lower cooling rates, less than 10 degrees per second.

Many of the recently discovered bulk glass forming alloys can be broadly described as pseudo-ternary alloys of the form $ETM_{1-x-y}LTM_xSM_y$. Typically the early transition metal couple, ETM, is a combination of elements from group IVB of the periodic table; e.g., Zr and Ti. The late transition metals, LTM, are typically combinations of the 3d transition metals from groups VIIIB and IB; e.g., Fe, Co, Ni, and Cu. The simple metal element, SM, is normally chosen groups from IIA or IIIA; e.g., Be, Mg or Al. However, the addition of a SM element is not a requirement for the formation of a bulk glass forming alloy. There are also bulk metallic glass forming alloys based on magnesium.

Examples of some of the composition manifolds that contain ideal bulk metallic forming compositions are as follows: Zr—Ti—Cu—Ni—Be, Zr—Nb—Cu—Ni—Al, Ti—Zr—Cu—Ni, and Mg—Y—Cu—Ni—Li. Each of the chemical species and their combinations are chosen for a given alloy composition such that the alloy composition lies in a region with a low-lying liquid surface. Alloy compositions that exhibit a high glass forming ability are generally located in proximity to deep eutectic features in the multicomponent phase diagram. These materials, including the recently developed families of Zr-based bulk metallic glass alloys show great promise as engineering materials. However, as in many metallic glasses, specimens loaded in a state of uniaxial or plane stress fail catastrophically on one dominant shear band, thus limiting their global plasticity.

Specimens loaded under constrained geometries (plane strain) fail in an elastic/perfectly-plastic manner by the generation of multiple shear bands. Multiple shear bands are observed when the catastrophic instability is avoided via mechanical constraint. This behavior under deformation has limited the application of bulk metallic glasses as engineering materials.

SUMMARY

The present application teaches a new class of metallic glass materials that employ the previously unknown physical mechanism of shear band pattern formation. The occurrence of shear band pattern formation dramatically increases the plastic strain to failure, impact resistance, and toughness of the material.

To exploit this phenomenon, a metallic glass matrix is combined with a ductile metal or metal alloy phase. The metallic glasses of this type may be glassy matrix composites based on bulk glass forming compositions in any bulk metallic glass forming alloy system. Formation of these objects is carried out using standard powder metallurgy techniques, at temperatures that are below the melting point of the individual constituents. Combinations of powders comprised of bulk metallic glass forming particles and crystalline ductile metal or metal alloy phases are employed. To prepare a ductile metal/bulk metallic glass matrix composite material, mixtures of metal or metal alloy powders are mixed with the bulk metallic glass powders, followed by processing in the super cooled liquid region ("SLR"). The SLR is defined as the difference in temperature between the glass transition and crystallization temperatures of the glass matrix. This temperature interval is defined as $\Delta T=(T_x-T_g)$, where $T_g$ and $T_x$ are the glass transition, and crystallization temperatures, respectively, of the bulk metallic glass constituent which is used to prepare the consolidated powder product or composite, and with the geometry desired. The control of the relative volume fractions of the ductile metal or metal alloy particles and bulk metallic glass matrix is simply controlled by the initial the mixing ratio. The maximum properties allowed by shear band pattern formation upon mechanical deformation are readily controlled in composites prepared in this fashion. This method also allows for bulk metallic glass matrix particles which incorporate crystalline ductile metal phases, formed from the molten state in situ, with a possible further increase in properties. The length scales, or size ranges, associated with the ductile metal or metal alloy phases may be of significantly differing magnitudes. Hence, these differing scales may result in duplex, triplex, or higher order multiplex morphological structures for the added particle sizes; each with a specific purpose. Namely, there will be a preferred size range, of the order of microns in which shear band pattern formation is encouraged. The particles added with larger length scales will further toughen the composite material formed by use of traditional composite toughening mechanisms such as, crack bridging, fiber pull-out, etc. The formation of shear band patterns through the material may cause new effects that had not been previously known in the art.

DETAILED DESCRIPTION

The present invention describes a material formed by a specified combination of ductile metal and bulk metallic glass matrix. More specifically, the system describes crystalline ductile metal particles being existing within a matrix of amorphous bulk metallic glass. Specific materials are described herein, but it should be understood that other materials may be used and other formation techniques. The system operates to toughen bulk metallic glasses using included ductile phases in a composite comprised of a metallic glass matrix.

For introductory purposes only, consider an embodiment for disclosure of the example of shear band pattern forming observed via in situ precipitation from the liquid state in the Zr—Ti—Cu—Ni—Be alloy system. The bulk glass forming compositions in the Zr—Ti—Cu—Ni—Be system are compactly written in terms of a pseudo-ternary Zr—Ti—X phase diagram, where X represents the moiety $Be_9Cu_5Ni_4$. Results have been obtained for alloys of the form $(Zr_{100-x-z}Ti_xM_z)_{100-y}X_y$, where M is an element that stabilizes a crystalline beta-phase in Ti- or Zr-based alloys. The composition of specific interest is $(Zr_{75}Ti_{18.34}Nb_{6.66})_{75}X_{25}$; i.e., an alloy with M=Nb, z=6.66, x=18.34, and y=25. Upon cooling from the high temperature melt, the alloy undergoes partial crystallization by nucleation and subsequent dendritic growth of the beta-phase in the remaining liquid. The remaining liquid subsequently freezes to the glassy state. This produces a two-phase microstructure containing beta-phase dendrites in a glass matrix.

The inherent properties of the final material impose constraints on the glassy matrix. Upon deformation these constraints lead to the generation of highly organized shear band patterns throughout the material. In the deformed regions of the material regularly spaced shear bands are seen where the spacing is coherent with the microstructural length scale. The patterns formed exist within domains that are dependent on the local orientation of the crystalline phase, and may have a spatial range extending up to 100 microns. Within each domain, regular parallel arrays of shear bands are observed at a spacing of typically 2 to 10 microns. This spacing may coincide with the secondary arm spacing of the beta-phase dendrites. Individual shear bands may occur, and may propagate through the ductile dendrites as highly localized twins.

The materials obtained may have a plastic strain to failure of up to or greater than 20 percent under unconfined loading conditions.

The initiation and propagation of the shear bands may be controlled by the scale and geometry of the ductile phase dispersion. The result is that deformation occurs through the development of highly organized patterns of regularly spaced shear bands that are distributed uniformly throughout the sample.

A monolithic bulk metallic glass object may be prepared from bulk metallic glass forming powders. These bulk metallic glass forming powders could be prepared via mechanical alloying (ball milling), rotary or centifugal atomization, gas or spray atomization, rotating anode, and/or sol-gel processes to name a few examples. The prior art in this area is extensive. This technique uses conventional powder metallurgy processing techniques, such as extrusion, hot-pressing, forging, rolling, and drawing to compact objects from the constituent powders. There are certain advantages to this technique. The compacted powder only requires heating to a relatively low temperature since consolidation of the powder is carried out in the supercooled liquid region or SLR.

In the Zr-based bulk metallic glasses, these operations are typically carried out around 300 to 400 degrees Celsius or 573 to 673 Kelvin (K). For an ideal system, the width of the supercooled liquid region should be relatively wide; e.g. 100 degrees Kelvin (K), in order to facilitate powder metallurgy processing techniques. Certain materials such as Zr-based alloys may facilitate formation in this region. This technique may also be applied to aluminum- and iron-based bulk metallic glass alloy systems. In all of said systems, once the object is formed, it should be cooled sufficiently rapidly so as to retain the metallic glass condition.

A bulk metallic glass matrix composite object that exhibits shear band pattern formation may also be formed by mixing of ductile metal or metal alloy powders with bulk metallic glass powders followed by compaction using powder metallurgy techniques. Specified metals or metal alloy powders are mixed with bulk metallic glass powders. Processing is again carried out in the supercooled liquid region to prepare the consolidated powder product or composite, having the desired geometry. The materials could be extruded under vacuum in an appropriate canister, such as copper, at pressures of the order 100 Mega Pascals (Mpa). The processing temperature could be reduced by using higher compaction pressures. The relative volume fractions of the materials are controlled by controlling an initial mixing ratio of ductile metal to bulk metallic glass. The control of the degree of shear band pattern formation upon mechanical deformation therefore may also be controlled. Since bulk powders are used, it may be easier to provide specified tailored microstructural properties based on different ratios between the ductile metal in the bulk metallic glass matrix material. Consider the following examples.

EXAMPLE 1

A ductile metal reinforced bulk metallic glass matrix composite could be formed via SLR processing by incorporating powders of ductile crystalline Ti—Zr—Nb—Cu—Ni particles with beta-phase crystal symmetry, embedded in a Zr—Ti—Cu—Ni—Be bulk metallic glass matrix. Specific chemical compositions could have crystalline beta-phase particles with chemical compositions near $Zr_{71}Ti_{16.3}Nb_{10}Cu_{1.8}Ni_{0.9}$, and a bulk metallic glass matrix with composition $Zr_{41.2}Ti_{13.8}Cu_{12.5}Ni_{10}Be_{22.5}$. The latter bulk metallic glass former has a glass transition temperature near 623 K. The SLR width is near 80K. This matrix material is vitrified at 1.8 K/s making it a useful matrix material for composite applications. However, the beryllium containing systems are of reduced interest due to the health hazards associated with beryllium.

EXAMPLE 2

Another ideal example would incorporate as a glass matrix the $Zr_{58.5}Nb_{2.8}Cu_{15.6}Ni_{12.8}Al_{10.3}$ composition. This alloy exhibits a glass transition temperature near 673 K, and could thus be compacted in this temperature regime. The SLR width is near 100 K. Specific chemical compositions for the crystalline beta-phase particles could again have compositions near $Zr_{71}Ti_{16.3}Nb_{10}Cu_{1.8}Ni_{0.9}$. Other crystalline Zr-based alloys warrant examination.

EXAMPLE 3

Another example incorporates $Mg_{62}Cu_{25}Y_{10}Li_3$ composition as a glass matrix. This alloy exhibits a glass transition temperature near 414 K, and could thus be compacted in this temperature regime. The SLR width is near 75 K. This matrix material is favorable for applications where density is of prime consideration. For the Mg-based composite, a number of crystalline magnesium alloys could be considered.

EXAMPLE 4

Another example uses as a glass matrix the $Ti_{34}Zr_{11}Cu_{48}Ni_7$ composition. This alloy forms bulk metallic glasses with millimeter dimensions. The critical cooling rate however, is much greater than the previous examples given. This alloy exhibits a glass transition temperature near 673 K, and could thus be compacted in this temperature regime. The SLR width is near 45 K. This alloy has been prepared, in monolithic form, via powder metallurgy methods. To form a composite, specific chemical compositions for the crystalline ductile particles could have compositions comprised of a number of Ti-based alloys. For example, the common alpha-beta alloy Ti-6Al-4V.

Other embodiments are within the disclosed embodiment. What is claimed is:

1. A method, comprising:

forming a bulk metallic glass matrix using powder metallurgy; and controlling properties of said bulk metallic glass matrix to form multiple shear bands under mechanical loading or deformation, wherein said controlling comprises adding a ductile metal material to the bulk metallic glass matrix over a range of 5–50 percent per unit volume.

2. At A method as in claim 1, wherein the bulk metallic glass matrix is a Zr—Ti—Cu—Ni—Be glass material.

3. A method as in claim 1, wherein the bulk metallic glass matrix is a Zr—Nb—Cu—Ni—Al glass material.

4. A method as in claim 3, wherein said ductile metal material is a Ti—Zr—Nb material.

5. A method as in claim 3, wherein said ductile metal material is a FeNiSi alloy.

6. A method as in claim 1, wherein the bulk metallic glass matrix is a Zr—Ti—Cu—Ni—Al glass material.

7. A method as in claim 1, wherein the bulk metallic glass matrix is a Zr—Ti—Cu—Ni glass material.

8. A method as in claim 1, wherein said ductile metal material is a beta phase material.

9. A method as in claim 1, wherein said ductile metal material is a alpha phase material.

10. A method as in claim 1, wherein said ductile metal material is a gamma phase material.

11. A method as in claim 1, wherein the bulk metallic matrix is a MgCuNiAlY material.

12. A method as in claim 1, wherein said forming comprises obtaining a powder of glass matrix material, mixing said powder of glass matrix material with a powder of ductile metal material to form a mixed powder, and forming a bulk metallic glass matrix material from the mixed powder.

13. A method as in claim 12, wherein said forming comprises forming a glass in a supercooled liquid region.

14. A method as in claim 12, further comprising adjusting the ratio between the powder of glass matrix material and the powder of ductile metal material to change a characteristic of the bulk metallic glass matrix material, wherein the hulk metallic glass matrix material is present in an amount greater than 50% per unit volume.

15. A method for forming a composite amorphous metal object comprising:

heating a composite mixture comprising an amorphous metal alloy and a ductile metal phase to a super cooled liquid region temperature of the amorphous metal alloy; and forming said composite amorphous metal object using a powder metallurgy technique, wherein the ductile metal phase comprises in the range of from 5 to 50 volume percent of the composite.

16. A method as in claim 15, wherein said powder metallurgy technique includes at least one of extrusion, hot forming.

17. A method as in claim 15 further comprising cooling after consolidation and forming to a temperature below a glass transition temperature of the amorphous metal alloy sufficiently rapidly so as to prevent crystallization of the amorphous metal alloy.

18. A method comprising:

forming a composite amorphous metal object by obtaining a powder of an amorphous metal alloy matrix material, mixing said powder with a second powder material, comprising an additional ductile phase, and using powder metallurgy techniques to form a composite material from mixed powders to form the composite amorphous metal object, wherein the ductile phase comprises in the range of from 5 to 50 volume percent of the composite.

19. A method as in claim 18, wherein said forming comprises forming said composite material such that said second powder material is formed as dendrites in said amorphous metal alloy matrix material.

20. A method as recited in claim 19 wherein the forming comprises adjusting the ratio between the different kinds of powders to alter the characteristics of said mixture.

* * * * *